US007832836B2

(12) United States Patent
Iwasaki et al.

(10) Patent No.: US 7,832,836 B2
(45) Date of Patent: Nov. 16, 2010

(54) INK JET PRINTING APPARATUS AND INK JET PRINTING METHOD

(75) Inventors: Osamu Iwasaki, Tokyo (JP); Kiichiro Takahashi, Kanagawa (JP); Naoji Otsuka, Kanagawa (JP); Minoru Teshigawara, Kanagawa (JP); Tetsuya Edamura, Kanagawa (JP); Yoshinori Nakagawa, Kanagawa (JP); Satoshi Seki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 10/863,500

(22) Filed: Jun. 9, 2004

(65) Prior Publication Data

US 2004/0252160 A1 Dec. 16, 2004

(30) Foreign Application Priority Data

Jun. 13, 2003 (JP) ..... 2003-169968

(51) Int. Cl.
*B41J 2/15* (2006.01)
*B41J 2/21* (2006.01)

(52) U.S. Cl. ..... 347/40; 347/41; 347/43

(58) Field of Classification Search ..... 347/15, 347/40–43, 37, 19
See application file for complete search history.

(56) References Cited

U.S. PATENT DOCUMENTS

| | | | | |
|---|---|---|---|---|
| 4,593,295 | A | 6/1986 | Matsufuji et al. | 347/41 |
| 5,604,520 | A | 2/1997 | Matsubara et al. | 347/43 |
| 5,818,474 | A | 10/1998 | Takahashi et al. | 347/15 |
| 5,852,454 | A | 12/1998 | Kanematsu et al. | 347/43 |
| 5,975,678 | A | 11/1999 | Kanematsu et al. | 347/43 |
| 6,007,181 | A | 12/1999 | Takahashi et al. | 347/41 |
| 6,042,212 | A | 3/2000 | Takahashi et al. | 347/15 |
| 6,053,595 | A | 4/2000 | Otsuka et al. | 347/9 |
| 6,086,184 | A | 7/2000 | Iwasaki et al. | 347/40 |
| 6,102,511 | A | 8/2000 | Shioya et al. | 347/9 |
| 6,142,598 | A | 11/2000 | Iwasaki et al. | 347/9 |
| 6,178,009 | B1 * | 1/2001 | Yamada et al. | 358/1.9 |
| 6,234,601 | B1 | 5/2001 | Hayashi et al. | 347/16 |
| 6,315,387 | B1 | 11/2001 | Horikoshi | 347/40 |
| 6,426,765 | B1 | 7/2002 | Iwasaki et al. | 347/12 |
| 6,467,896 | B2 * | 10/2002 | Meyer et al. | 347/101 |

(Continued)

FOREIGN PATENT DOCUMENTS

EP 0 872 344 A2 10/1998

(Continued)

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

In an ink jet printing apparatus using many types of inks to execute bidirectional printing, when symmetrically arranged ejection opening rows for a cyan, magenta, and yellow inks are used in the print head, one-pass bidirectional printing is executed. On the other hand, if ejection opening rows for a black ink are used in addition to the above ejection opening rows, multi-pass printing is executed so that there are a number of dots formed with one application order for the black and other color inks and the same number of dots formed with another application order for the black and other color inks. This reduces the non-uniformity of the colors attributed to the difference in application order.

3 Claims, 10 Drawing Sheets

U.S. PATENT DOCUMENTS

| | | | | |
|---|---|---|---|---|
| 6,527,364 | B2 | 3/2003 | Takahashi et al. | 347/40 |
| 6,533,382 | B1 * | 3/2003 | Tomida et al. | 347/15 |
| 6,533,392 | B1 * | 3/2003 | Koitabashi | 347/43 |
| 6,557,964 | B2 | 5/2003 | Kawatoko et al. | 347/15 |
| 6,601,939 | B2 | 8/2003 | Fujita et al. | 347/15 |
| 6,626,517 | B2 | 9/2003 | Iwasaki et al. | 347/40 |
| 6,652,065 | B2 | 11/2003 | Nakagawa | 347/32 |
| 6,669,331 | B2 | 12/2003 | Teshigawara et al. | 347/43 |
| 6,682,168 | B2 | 1/2004 | Nakagawa et al. | 347/40 |
| 6,688,716 | B2 | 2/2004 | Kanda et al. | 347/16 |
| 6,719,402 | B2 | 4/2004 | Nakagawa et al. | 347/37 |
| 6,719,403 | B2 | 4/2004 | Kanda et al. | 347/40 |
| 6,729,710 | B2 | 5/2004 | Chikuma et al. | 347/14 |
| 2002/0039192 | A1 | 4/2002 | Otsuka et al. | 358/1.9 |
| 2002/0057308 | A1 | 5/2002 | Iwasaki et al. | 347/41 |
| 2002/0070999 | A1 * | 6/2002 | Teshigawara et al. | 347/41 |
| 2002/0105559 | A1 | 8/2002 | Nishikori et al. | 347/19 |
| 2002/0154182 | A1 | 10/2002 | Takahashi et al. | 347/12 |
| 2002/0167565 | A1 | 11/2002 | Maeda et al. | 347/40 |
| 2003/0095161 | A1 * | 5/2003 | Ohde | 347/19 |
| 2003/0184608 | A1 | 10/2003 | Masuyama et al. | 347/12 |
| 2003/0214555 | A1 | 11/2003 | Teshigawara et al. | 347/43 |
| 2004/0085427 | A1 * | 5/2004 | Lee | 347/104 |

FOREIGN PATENT DOCUMENTS

| | | | |
|---|---|---|---|
| EP | 1 228 881 | A2 | 8/2002 |
| JP | 11-1647 | | 1/1999 |
| JP | 2000-318189 | | 11/2000 |
| JP | 2001-96771 | | 4/2001 |

* cited by examiner

INK JET PRINTING APPARATUS AND INK JET PRINTING METHOD

BACKGROUND OF THE INVENTION

1. Field of the Invention

The present invention relates to an ink jet printing apparatus, and more specifically, to an ink jet printing apparatus that executes printing by scanning a printing head in two directions.

2. Description of the Related Art

With the recent spread of personal computers, word processors, facsimile machines, and the like to offices and homes, printing apparatuses based on various printing systems have been provided as information output equipment for the above equipment. In particular, printing apparatuses such as printers which are based on an ink jet system can be relatively easily adapted to execute color printing using plural types of inks. The ink jet printing apparatus has various advantages; for example, it makes only a low noise during operation, can achieve high grade printing on a variety of print media, and is small in size. In this respect, the printer based on this system and the like are suitable for personal use at office or home. Of these ink jet system-based printing apparatuses, a serial type in which a printing head reciprocates to perform printing to a printing medium is very popular because it is inexpensive and can print high grade images.

In spite of its relatively low costs, the serial type printing apparatus is desired to exhibit a higher performance. The printing performance is typified by image quality or image grade, and printing speed.

One of factors that determine image quality or the like is the type of ink. In general, the use of more or appropriate types of inks allows a higher-quality image to be printed. The inks can be classified into dye inks, pigment inks, and the like on the basis of coloring materials used for the inks, or dark and light inks on the basis of the concentration of the coloring materials, or a special color such as orange, red, blue inks, and the like on the basis of ink colors.

Well-known printers use, for example, six types of inks including a dye black ink, a dye yellow ink, a dark and light dye magenta inks, and a dark and light dye cyan inks, or four types of inks including a pigment black ink, a dye yellow ink, a dye magenta ink, and a dye cyan ink. The former apparatus focuses on the output to gloss printing media of photographic images of high quality inputted using a digital camera, a scanner, or the like. The latter apparatus focuses on the high-grade output to ordinary paper of black lines such as black letters and charts.

In general, to obtain a high optical reflection density for black, pigment coloring materials such as carbon black are used to perform printing to an ordinary paper rather than using dye color materials as described above. This is because the pigment is dispersed in the ink and because when this ink is applied to the ordinary paper, the dispersion becomes unstable to cause coagulation, resulting in the effective coverage of the surface of the printing medium. Further, when the ink has a surface tension of about 40 dyne/cm, this prevents the ink from bleeding along fibers in the ordinary paper. Such ink designs enable the printing of letters and lines having a high contrast with respect to the surface of the paper as well as sharp edges. On the other hand, the dye dissolves in the ink at a molecular level, whereas the pigment is dispersed in the ink and thus has relatively large coloring material grains. Thus, the pigment cannot pass through a gloss layer in the surface of a glossy printing medium. The pigment accumulates in the surface of the gloss layer to reduce the glossiness.

Thus, when performing printing to a gloss printing medium, the above printing apparatus using a pigment black ink often expresses a black component of an image by using what is called a process black composed of three color inks, a dye yellow ink, a dye magenta ink, and a dye cyan ink, instead of using a pigment black ink. However, to improve the contrast of a black image in a print, it is more preferable to use a dye black ink than to use the three-color inks. In this case, only the dye black ink is used, thus enabling a reduction in the amount of ink applied per unit area of a printing medium. This prevents problems such as ink bleeding. Further, if a gray level is to be expressed in a print image, dots for a color of a relatively high gray level are generally formed by applying a black ink as well as a cyan, magenta, and yellow inks.

In this manner, combinations of various inks are used depending on the type of images to be printed or printing media used. For example, when ordinary paper is important, the apparatus is configured to use a pigment black ink. If gloss printing media are important, the printing apparatus uses a dye black ink.

In contrast, Japanese Patent Application Laid-open No. 11-001647 (1999) describes a configuration focusing on both ordinary paper and gloss printing media. According to this document, the configuration has printing means for a pigment black ink and printing means for a dye black ink. It does not use the pigment black ink but only the dye black ink to perform printing to printing media that have a gloss layer and an ink receiving layer and that are incompatible with the pigment black ink. It uses the pigment black ink to perform printing to the ordinary paper. In this manner, this configuration can print a high-quality or -grade image on both ordinary paper and gloss print media.

Bidirectional printing is known as a configuration that can improve the printing speed, belonging to the printing performance. With this printing system, in a serial type printing apparatus, the printing head is first scanned in a forward direction for printing. Then, paper is fed by a predetermined amount, and printing scan is subsequently executed again by moving the printing head in a backward direction. This printing system achieves an approximately double printing speed or throughput compared to unidirectional printing in which printing is executed during forward scanning, whereas it is not executed while the printing head is moving in the backward direction. Other known printing systems include what is called one pass printing in which one scan completes printing of a scan area of a width equal to the arrangement width of ejection openings in the printing head, and what is called multi-pass printing in which printing is completed by a plurality of scans between which paper feeding is interposed. The above bidirectional printing system can also achieve the one pass printing and multi-pass printing. If the one pass printing is executed using the bidirectional printing system, the printing speed or throughput can be maximized.

The bidirectional printing system is effective means in improving the printing speed or the like as described above. However, this system is known to vary colors with scan areas, leading to non-uniform colors or color drifts in a printed image. This is because the application order of the color inks differs between the forward and backward directions of the bidirectional printing. In the printing apparatus, ejection opening rows for the respective color inks are commonly arranged in the scanning direction. However, in this case, the application order may be reversed between the forward scanning and the backward scanning depending on the arrangement of the ejection opening rows.

If dots of a predetermined color are to be formed by applying (ejecting) plural types of inks so that these inks are superposed on a pixel, inks applied to a printing medium earlier more favorably develop their colors. This is because the inks applied to the printing medium earlier easily color the material in a layer closer to the front surface of the printing medium, while the inks applied to the printing medium later less easily color the material in the front surface of the printing medium and permeates deeper through the printing medium in its thickness direction before they are settled. This phenomenon is significant if the ink receiving layer is composed of coat paper consisting of silica. However, it also occurs on ordinary paper or gloss printing media having a gloss layer formed in their front surface and an ink receiving layer formed inside the gloss layer.

Japanese Patent Application Laid-open Nos. 2000-318189 (for example, FIG. 6) and 2001-096771 (for example, FIG. 5) describe a configuration that can avoid non-uniform colors or the like attributed to the application order of inks. In this configuration, two nozzle rows are provided for the respective color inks and arranged symmetrically with respect to an axis orthogonal to the scanning direction. These documents disclose the configuration in which nozzle rows c1 and c2 for a cyan ink, nozzle rows m1 and m2 for a magenta ink, and nozzle rows y1 and y2 for a yellow ink are each arranged symmetrically with respect to a predetermined axis of symmetry orthogonal to the scanning direction of the printing head, for example. In this configuration, to form an ink dot for each pixel, the inks are ejected (applied) in order of c1, m1, y1, y2, m2, and c2 in the forward scanning direction. The inks are ejected (applied) in order of c2, m2, y2, y1, m1, and c1 in the backward scanning direction. This enables the inks to be applied or superposed on one another in the same order between the forward scanning and the backward scanning. Further, Japanese Patent Application Laid-open No. 2001-096771, mentioned above, discloses a configuration in which a symmetrical arrangement is also used for the black ink. However, Japanese Patent Application Laid-open Nos. 2000-318189 and 2001-096771, mentioned above, also disclose a printing head configuration with one or two nozzle rows in which the above symmetrical arrangement is not used for the black ink.

Specifically, these documents disclose a printing head that applies different types of inks to each pixel, the printing head being composed of nozzle rows that eject the cyan, magenta, and yellow inks, for which two types of application orders are available in relation to the scanning direction, and nozzle rows for the black ink, for which the application order varies depending on the scanning direction, in connection with the other types of inks.

Further, Japanese Patent Application Laid-open No. 2001-096771 uses the above printing head configuration and uses a mixture of pixels with different application orders in printing an image so that for the entire image, the number of pixels with one application order is substantially the same as that with another application order. This configuration reduces the non-uniformity of the colors attributed to the application order regardless of print data.

However, if the number of inks used in an apparatus capable of bidirectional printing is simply increased in order to consistently improve image quality and grade as well as the printing speed, the print head must be configured so that symmetrically arranged nozzle rows are also provided for these inks. If a dye black ink, a light magenta ink, a light cyan ink, or what is called a special color ink such as an orange ink, a red ink, or a green ink is used, two symmetrical nozzle rows must be provided for these inks. This results in an increase in the size of the printing head. Therefore, this configuration is disadvantageous in terms of costs and the size of the printing apparatus.

On the other hand, if asymmetrically arranged nozzle rows are additionally provided for the added inks, then the order in which this ink and the other inks are applied varies depending on the scanning direction. Then, the resultant colors may not be uniform, thus degrading the image quality.

SUMMARY OF THE INVENTION

It is an object of the present invention to provide an ink jet printing apparatus configured to execute bidirectional printing using many types of inks and which achieves high speed and high-grade printing by reducing the non-uniformity of the colors attributed to the bidirectional printing, while preventing an increase in the size of a printing head.

In the first aspect of the present invention, there is provided an ink jet printing apparatus that uses a printing head and scans the printing head over a printing medium in forward and backward directions so that during each of a forward scan and a backward scan of the printing head, dots are formed by superposing a plurality types of ink ejected from ejection openings of the printing head so as to perform printing to the printing medium, wherein the printing head has an arrangement of ejection openings for ejecting each ink in a combination of first inks among the plurality types of ink, in which inks have two different overlapping orders with each other in each of the forward and the backward scans, and an arrangement of ejection openings for ejecting each ink in a combination of second inks among the plurality types of ink, for which an overlapping order varies between the forward and the backward scans, and the ink jet printing apparatus comprising:

print mode performing means for selectively performing a first print mode that uses the combination of first inks and completes printing for an area by each of the forward and the backward scans, in which the printing head is scanned over the area, and a second print mode that uses the combination of second inks and completes printing for an area by a plurality times of scan of the printing head, of the forward and the backward scans, for the area and by different ejection openings being made correspondence with the area in each of the plurality of time of scan.

In the second aspect of the present invention, there is provided an ink jet printing method that uses a printing head and scans the printing head over a printing medium in forward and backward directions so that during each of a forward scan and a backward scan of the printing head, dots are formed by superposing a plurality types of ink ejected from ejection openings of the printing head so as to perform printing to the printing medium, wherein the printing head has an arrangement of ejection openings for ejecting each ink in a combination of first inks among the plurality types of ink, in which inks have two different overlapping orders with each other in each of the forward and the backward scans, and an arrangement of ejection openings for ejecting each ink in a combination of second inks among the plurality types of ink, for which an overlapping order varies between the forward and the backward scans, and the ink jet printing method comprising:

a print mode performing step for selectively performing a first print mode that uses the combination of first inks and completes printing for an area by each of the forward and the backward scans, in which the printing head is scanned over the area, and a second print mode that uses the combination of second inks and completes printing for an area by a plurality times of scan of the printing head, of the forward and the backward scans, for the area and by different ejection openings being made correspondence with the area in each of the plurality of time of scan.

According to the above configuration, in bidirectional printing in which the printing head is scanned in a forward and backward directions for printing, when any of the second combination of inks is used for which the ink overlapping order varies between the forward scanning and the backward scanning, the second print mode for what is called multi-pass printing is executed which completes printing a print area by carrying out a plurality of scans and associating different ejection openings with the respective scans. Accordingly, even if an ink is added to the first combination of inks for which there are two ink overlapping orders that differ between the forward scanning and the backward scanning, the multi-pass printing can be used to reduce the possible non-uniformity of the colors attributed to the bidirectional printing without, for example, symmetrically arranging the ejection openings for the added ink as in the case of the first combination of inks.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

First Embodiment

For an ink jet printing apparatus according to a first embodiment of the present invention, a detailed description will be given of inks used, the configuration of a printing head, the configuration of a printer, and the like.

Inks

First, description will be given of inks used in an ink jet printer operating as the ink jet printing apparatus according to the first embodiment of the present invention.

In the present embodiment, two types of inks are used as a black ink in accordance with a print mode as described later. A first black ink is obtained by using a pigment composed of carbon black as a coloring material. The surface of the pigment is treated using a carboxyl group so as to be dispersed in the ink. Further, to inhibit the evaporation of moisture from the ink, it is preferable to add polyalcohol such as glycerin as a humectant. Moreover, since the pigment ink is used to print characters, it is important to prevent the degradation of the edge of black ink dots formed on ordinary paper. However, an acetylene glycol-based surfactant may be added to adjust the permeability of the ink to the extent that the edge is not degraded. Further, polymer may be added as a binder to improve the binding capacity between the pigment and a printing medium.

On the other hand, a second black ink uses a black dye as a coloring material. Further, a critical micelle concentration or higher of acetylene glycol-based surfactant is added to allow the ink to permeate through the front surface of the printing medium at a sufficiently high speed. Also for this ink, it is preferable to add polyalcohol such as glycerin as a humectant to inhibit the evaporation of moisture from the ink. Additionally, urea may be added to improve the solubility of the color material.

In the present embodiment, the color inks include a cyan ink, a magenta ink, and a yellow ink. These inks are composed of a cyan, magenta, and yellow dyes, respectively. It is preferable to add a humectant, a surfactant, and an additive similar to those for the second black ink to these inks.

Further, the surfactant is desirably adjusted so that the second black ink, the cyan ink, the magenta ink, and the yellow ink have approximately the same surface tension. By setting uniform permeability for ordinary paper, it is possible to inhibit the bleeding between areas on a sheet which are printed using different inks. Other characteristics such as the permeability and viscosity of the ink can be equally adjusted for the second black ink, cyan ink, magenta ink, and yellow ink.

Configuration of Printing Head

Now, with reference to FIGS. 1 and 2, description will be given of the configuration of a printing head according to the present embodiment.

Figure 1:
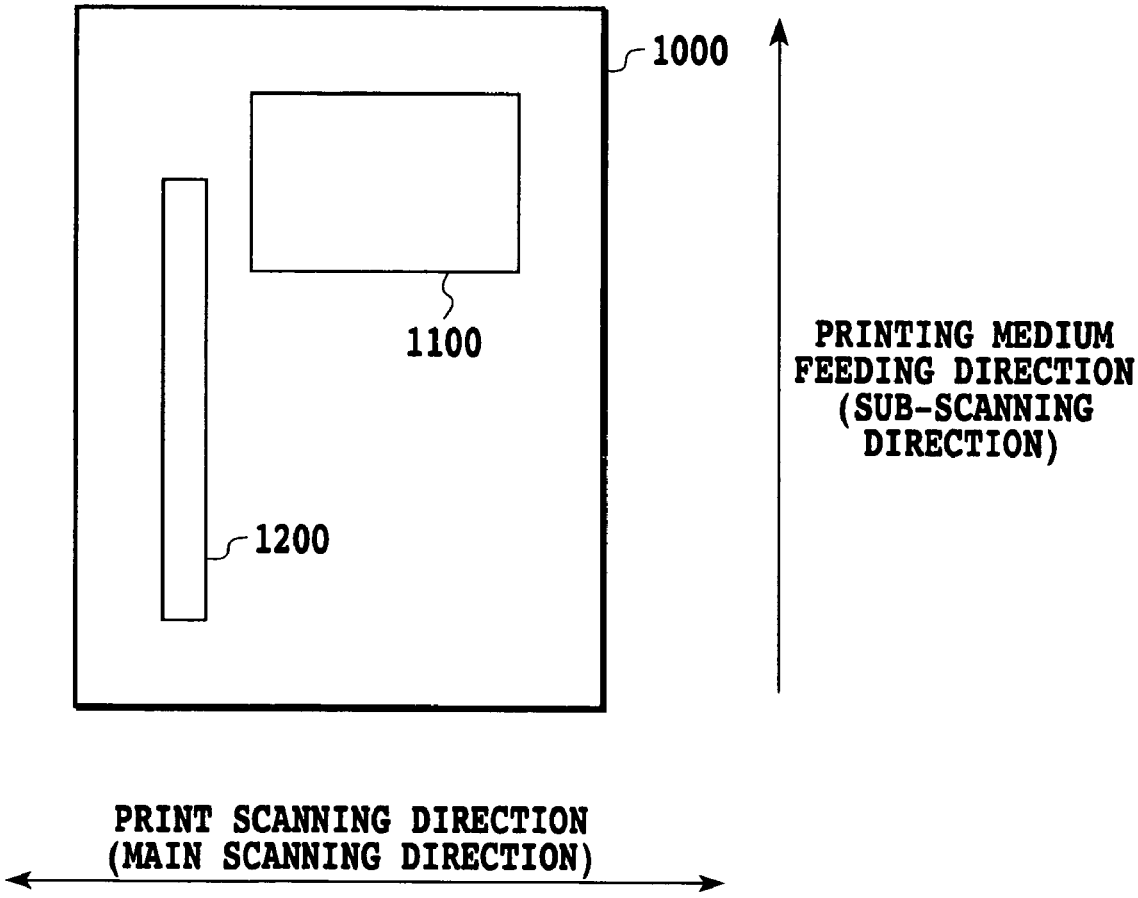
FIG. 1 is a schematic diagram illustrating the chip configuration of a printing head used in an embodiment of the present invention.

FIG. 1 is a schematic diagram of the printing head installed in the present printer as viewed from a printing medium; it shows the arrangement of each print chip.

As shown in this figure, the printing head according to the present embodiment is formed by attaching a color ink chip 1100 and a black ink chip 1200 on a substrate 1000. The black ink chip 1200 is composed of ejection openings (also referred to nozzles in the specification) through which the first black ink is ejected. This chip is longer than the color ink chip 1100 in the direction in which print media are conveyed (sub-scanning direction), that is, the ejection openings in this chip are arranged over a longer distance than those in the color ink chip 1100. Furthermore, the ejection opening row on this chip positionally deviate from the ejection opening row for each ink in the color ink chip by a predetermined amount in the sub-scanning direction. As illustrated in FIG. 1, on the downstream side in the conveying direction, the ends of the ejection opening rows arranged in the color ink chip 1100 are located more downstream of the end of the ejection opening row arranged in the black ink chip 1200. This is because the focus is placed on the printing speed accomplished if a document or the like is printed using the black ink chip. That is, a width in the sub-scanning direction which can be printed during one scan of the chip using the ejection row arranged in the black ink chip 1200 in the sub-scanning direction is larger than the corresponding width that can be printed using the ejection rows arranged in the color ink chip 1100. Furthermore, the color ink chip 1100 and the black ink chip 1200 positionally deviate from each other in the printing medium conveying direction so as to enable the pigment black ink to be applied, before the color inks, to the same printing area on the printing medium. This configuration creates a time difference between the ejection of the pigment black ink from the black ink chip 1200 and the printing using the color ink chip 1100. This in turn suppresses the possible ink bleeding between an image printed using the pigment black ink and an image printed using the dye color ink.

Figure 2:
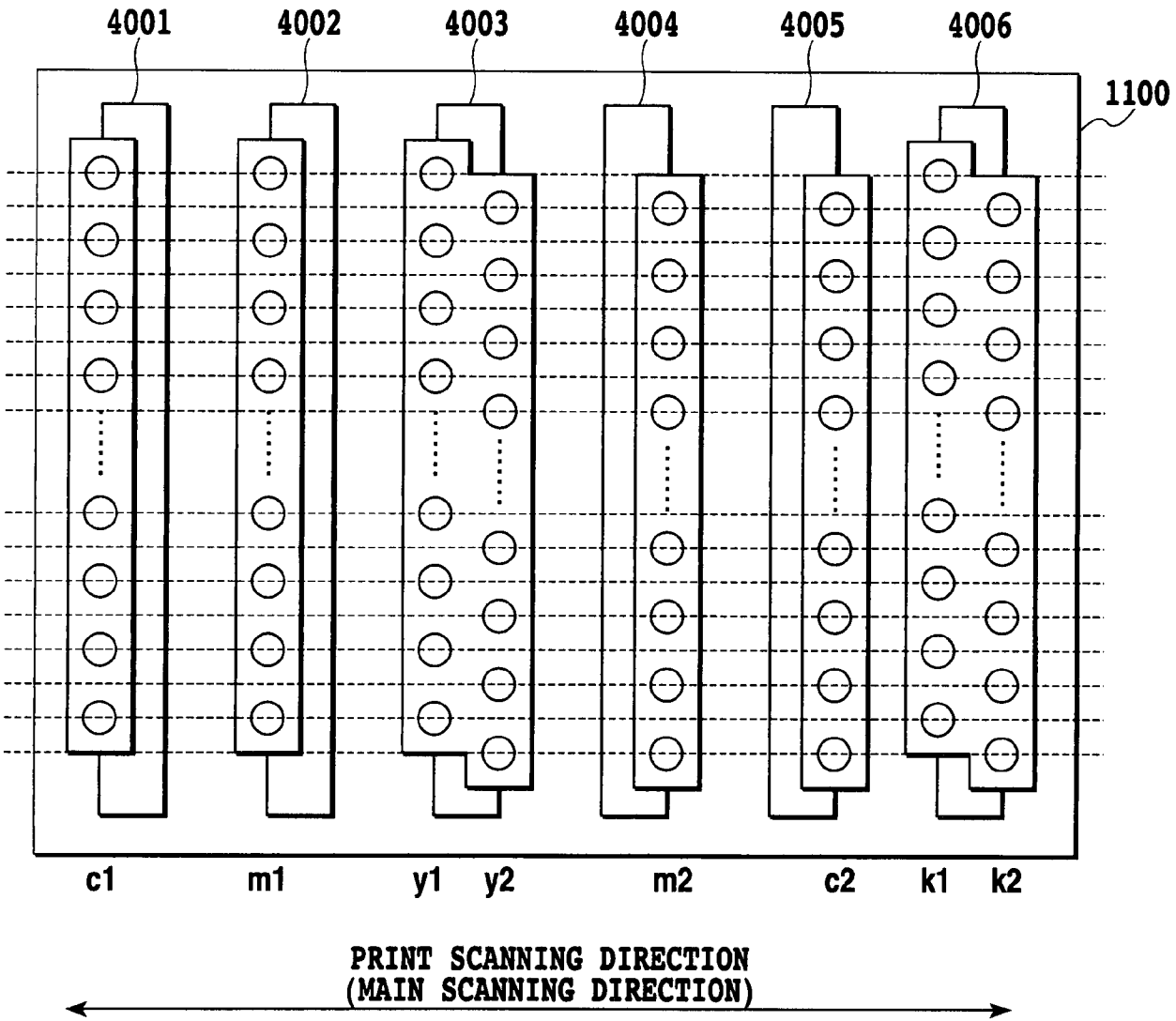
FIG. 2 is a diagram showing the arrangement of ejection opening rows in a color ink chip of a printing head used in a first embodiment of the present invention.

FIG. 2 is a schematic diagram showing the arrangement of the ejection openings for the respective colors in the color ink chip 1100.

The color ink print chip according to the present embodiment is provided with a plurality of openings for the cyan, magenta, yellow, and second black inks, and heaters that correspond to the respective ejection openings and that generate thermal energy utilized for ejection. Two ejection opening rows are provided for each color ink. The ejection opening rows are symmetrically arranged for the cyan, magenta, and yellow inks as previously described. However, such an arrangement is not used for the second black ink. Specifically, six grooves are formed in the same chip 1100 made of silicon. The above described ink ejection openings are formed in each of the grooves. That is, the following are formed: the ejection openings, the ink passages in communication with the ejection openings, the heaters each formed in a part of the corresponding ink passage, and the supply path common to these ink channels.

Further, driving circuits (not shown) are provided between the grooves in the chip 1100 to drive the heaters. The heaters and driving circuits are manufactured during a process of forming a semiconductor film. Furthermore, the ink channels and the ejection openings are formed of resin. Moreover, ink supply channels are formed in the back surface of the silicon chip to supply the ink to the respective grooves.

The six grooves, a first groove 4001, a second groove 4002, a third groove 4003, a fourth groove 4004, a fifth groove 4005, and a sixth groove 4006 are sequentially arranged in the scanning direction so that the first groove 4001 is closest to the left end of the figure. Then, in the present embodiment, the cyan ink is supplied to the first groove 4001 and fifth groove 4005. The magenta ink is supplied to the second groove 4002 and fourth groove 4004. The yellow ink is supplied to the third groove 4003. The second black ink, made using a dye as a color material, is supplied to the sixth groove 4006.

The nozzle row c1 for the cyan ink, composed of 64n (n is an integer equal to or larger than 1) ejection openings, is formed in the first groove 4001. The nozzle row m1 for the magenta ink, composed of 64n ejection openings, is formed in the second groove 4002. The nozzle row y1 for the yellow ink, composed of 64n ejection openings, is formed in the third groove 4003 and closer to the second groove. The nozzle row y2 for the yellow ink, composed of 64n ejection openings, is formed in the third groove 4003 and closer to the fourth groove. The nozzle row m2 for the magenta ink, composed of 64n ejection openings, is formed in the fourth groove 4004. The nozzle row c2 for the cyan ink, composed of 64n ejection openings, is formed in the fifth groove 4005. The nozzle row k1 for the dye black ink (second black ink), composed of 64n ejection openings, is formed in the sixth groove 4006 and closer to the fifth groove. The nozzle row k2 for the same dye black ink, composed of 64n ejection openings, is formed adjacent to the nozzle row k1 in the sixth groove 4006.

The ejection openings are arranged in each nozzle row at an approximately equal pitch. The nozzle rows for the same color ink are positionally deviate from each other by half an ejection opening arrangement pitch in the sub-scanning direction. This is to obtain the maximum efficiency of coverage of print media with print dots during one printing scan.

In the present embodiment, the combination of the cyan magenta, and yellow inks is referred to as a first ink combination. The combination of the cyan, magenta, yellow, and second black inks is referred to as a second ink combination. As is apparent from the symmetric arrangement shown in FIG. 2, if a secondary color is expressed using arbitrary two types of inks from the first ink combination, two application orders are available.

Figure 3:
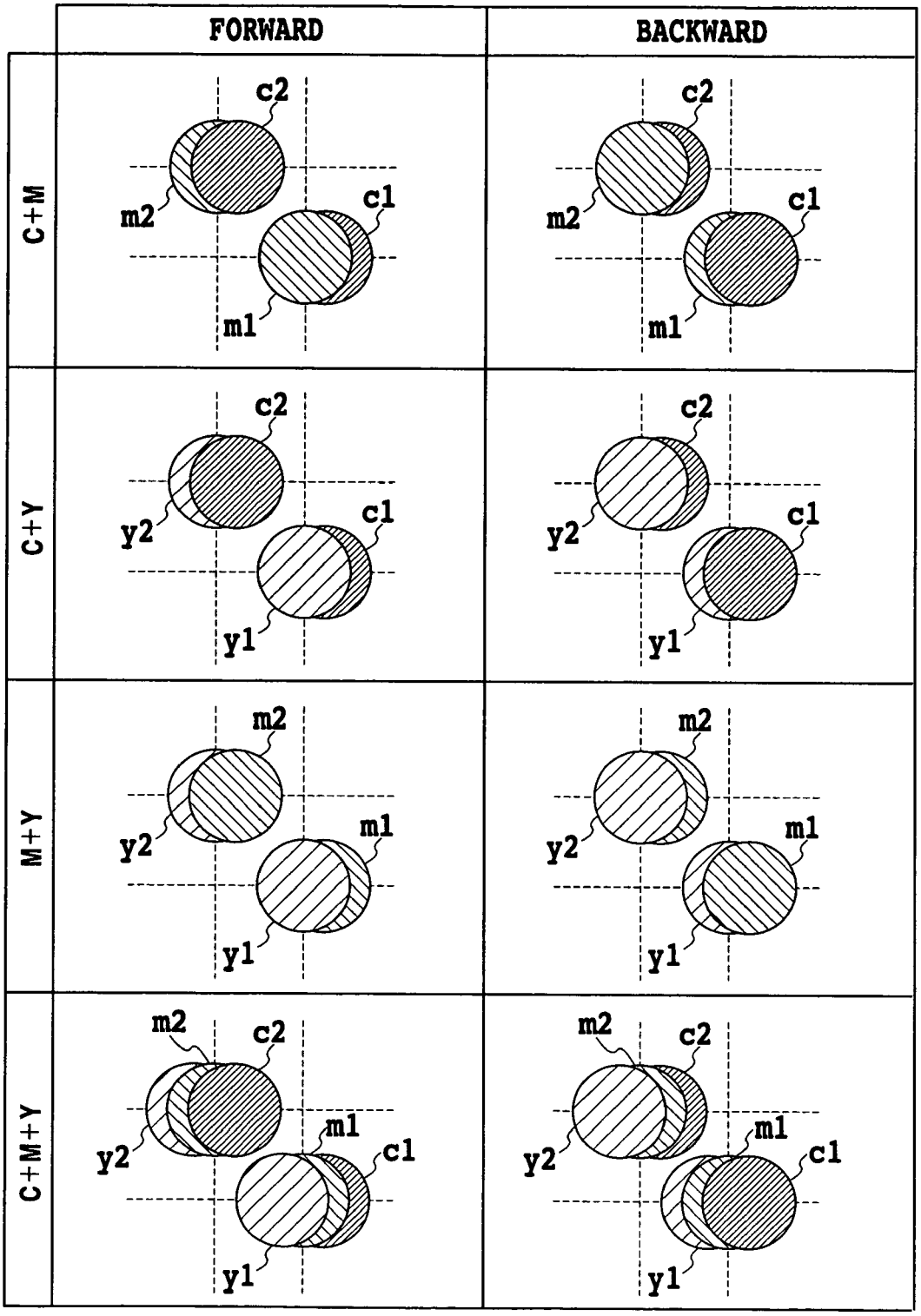
FIG. 3 is a diagram illustrating the relationship between combinations of a plurality of inks and their application order and a scanning direction of the printing head.

With reference to FIG. 3, a specific description will be given. In FIG. 3, the most dense hatched lines represent cyan dots (dots formed of the cyan ink; this applies to the other types of dots), the intermediate dense hatched lines represent magenta dots, and the least dense lines represent yellow dots. Further, in this figure, the dots are shifted from each other to make the reader understand the actual order of superimposition.

As is apparent from FIG. 3, for blue (C+M), which is a secondary color obtained by combining the cyan ink and the magenta ink together, two types of pixels, pixels for which the magenta ink is applied after the cyan ink and pixels for which the cyan ink is applied after the magenta ink, can be printed during the forward and backward scanning, respectively, using the set of the nozzle rows c1 and m1 and the set of the nozzle rows c2 and m2. The print data can be processed so that almost the same number of pixels are generated during the forward scanning and during the backward scanning. This can be accomplished using either one pass printing or multi-pass printing. As described above, in the present embodiment, instead of using the same order of application for all the pixels in the bidirectional printing, two types of application orders or dot superimposition manners are used. Further, the print data is processed so that almost the same number of pixels are generated for these two types. This makes the non-uniformity of the colors more insignificant which is attributed to the different application orders.

Likewise, for green (C+Y), which is a secondary color obtained by combining the cyan ink and the yellow ink together, two types of pixels, pixels for which the yellow ink is applied after the cyan ink and pixels for which the cyan ink is applied after the yellow ink, can be generated using the set of the nozzle rows c1 and y1 and the set of the nozzle rows c2 and y2. For red (M+Y), which is a secondary color obtained by combining the magenta ink and the yellow ink together, two types of pixels, pixels for which the yellow ink is applied after the magenta ink and pixels for which the magenta ink is applied after the yellow ink, can be generated using the set of the nozzle rows m1 and y1 and the set of the nozzle rows m2 and y2. Furthermore, for a tertiary color obtained using the cyan, magenta, and yellow inks, two types of pixels, pixels using the application order of cyan, magenta, and yellow and pixels using the application order of yellow, magenta, and cyan, can be generated using the set the nozzle rows c1, m1, and y1 and the set of nozzle rows c2, m2, and y2.

Configuration of Printer

Figure 4:
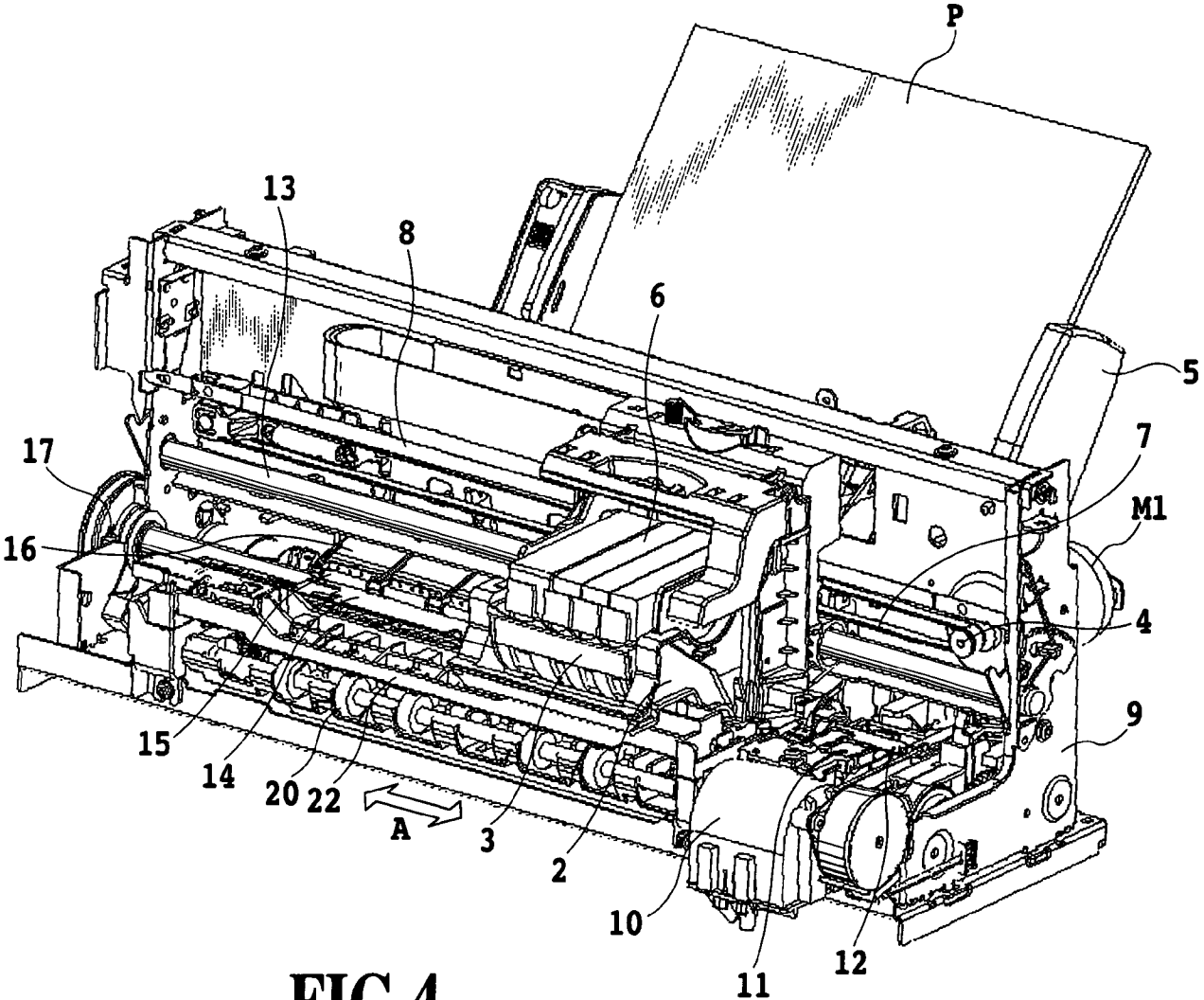
FIG. 4 is a perspective view showing the configuration of an ink jet printer according to an embodiment of the present invention.

FIG. 4 is a diagram showing the configuration of the ink jet printer according to the present embodiment. FIG. 4 is a perspective view showing the ink jet printer from which a case cover has been removed.

As shown in FIG. 4, the ink jet printer according to the present embodiment comprises a carriage 2 on which the printing head 3, described in FIG. 1, is detachably mounted, and a driving mechanism that moves the carriage 2 to scan the printing head. Specifically, the carriage 2 can be reciprocated in the direction of an arrow A in FIG. 4 by transmitting the driving force of a carriage motor M1 operating as a driving source, to the carriage 2 via a transmission mechanism such as a pulley. Ink cartridges 6 are detachably mounted on the carriage 2 in association with the types of inks used in the present printer. As described in FIGS. 1 and 2, the present embodiment uses the five types of inks including the first and second black inks, the cyan ink, the magenta ink, and the yellow ink. However, FIG. 4 is a simplified view showing only four ink cartridges.

The carriage 2 is formed with ink supply channels through which the inks from the corresponding cartridges are supplied to the grooves in the black ink chip 1200 and color ink chip 1100, show in FIGS. 1 and 2. The printing head 3, composed of the carriage 2 and the above described chips, are configured so that junction surfaces of both members can be properly contacted with each other for electric connections. Thus, in response to a print signal, the printing head 3 applies a voltage pulse to the previously described heaters to generate bubbles in the ink. Consequently, the pressure of the bubbles enables the ink to be ejected from the ejection openings. Specifically, a pulse is applied to the heaters, electrothermal converters, which then generate thermal energy. Thus, film boiling occurs in the ink to grow and contract bubbles to vary the pressure on the ink. As a result, the ink is ejected from the ejection openings.

The printer also comprises a paper feeding mechanism that conveys (feeds) print paper P that is a printing medium. The paper feeding mechanism feeds paper by a predetermined amount in accordance with the scanning of the printing head. Moreover, a recovery device 10 is provided at one end of the movement range of the carriage 2 to execute an ejection recovery process for the printing head 3.

In this ink jet printer, the paper feeding mechanism 5 feeds the print paper P into a scanning area of the printing head 3. The printing head 3 is scanned to print images, characters, or the like on the print paper P.

The configuration of this apparatus will be described in further detail. The carriage 2 is connected to a part of a driving belt 7 constituting a transmission mechanism 4 that transmits the driving force of the carriage motor M1. The carriage 2 is guided and supported so as to slide along a guide shaft 13 in the direction of the arrow A. This allows the driving force of the carriage motor M1 to be transmitted to the carriage 2 to move it. In this case, the carriage 2 can be moved forward or backward by rotating the carriage motor M1 forward or backward, respectively. In FIG. 4, reference numeral 8 denotes a scale used to detect the position of the carriage 2 in the direction of the arrow A. In the present embodiment, the scale is composed of a transparent PET film on which black bars are printed at a predetermined pitch. One end of the scale is secured to a chassis 9, while the other end is supported by a plate spring (not shown). A sensor provided on the carriage 2 can optically detect the bars on the scale to detect the position of the carriage 2.

In the scanning area of the printing head 3, platens (not shown) are provided in respective areas that lie opposite the corresponding ejection opening rows during the scanning of the printing head 3. The appropriate ink is ejected to the print paper P being conveyed on the platen to print the print paper 8 the flat surface of which is maintained by the platen.

Reference numeral 14 denotes a conveying roller driven by a conveying motor M2 (not shown). Reference numeral 15 denotes a pinch roller that abuts the print sheet against the conveying roller 14 using a spring (not shown). Reference numeral 16 denotes a pinch roller holder that rotatably supports the pinch roller 15. Reference numeral 17 denotes a conveying roller gear attached to one end of the conveying roller 14. The conveying roller 14 is driven by transmitting rotation of the conveying motor M2 to the conveying roller gear 17 via an intermediate gear (not shown). Reference numeral 20 denotes a discharge roller that discharges the print paper on which an image has been formed by the printing head 3, out of the apparatus. The discharge roller 20 is similarly driven by transmitting rotation of the conveying motor M2 to the roller 20. On the discharge roller 20, a spur roller (not shown) is abutted against the print paper by the pressure of a spring (not shown). Reference numeral 22 denotes a spur holder that rotatably supports the spur roller.

As described above, the recovery device 10 is provided at a predetermined position (for example, a position corresponding to a home position) outside the range (scanning range) of reciprocation of the carriage 2 for a printing operation. The recovery device 10 maintains the ejection performance of the printing head 3. The recovery device 10 comprises a capping mechanism 11 that caps an ejection opening surface of the printing head 3 and a wiping mechanism 12 that cleans the ejection opening surface (the surface provided with the ejection opening rows for the respective colors) of the printing head 3. An ejection recovery process can be executed by, for example, using a suction mechanism (a suction pump or the like; not shown) in the recovery device to force the ink to be discharged from the ejection openings in unison with the capping of the ejection openings by the capping mechanism 11, thus removing more viscous ink, bubbles, and the like from the ink channels in the printing head 3. Further, by capping the ejection opening surface of the printing head 3 during non-printing or the like, it is possible to protect the printing head, while preventing the ink from being dried. The wiping mechanism 12 is disposed close to the capping mechanism 11 to clean the printing head 3 by wiping off ink droplets attached to the ejection opening surface of the printing head 3. The capping mechanism 11 and the wiping mechanism 12 enable the printing head 3 to maintain normal ejections.

Figure 5:
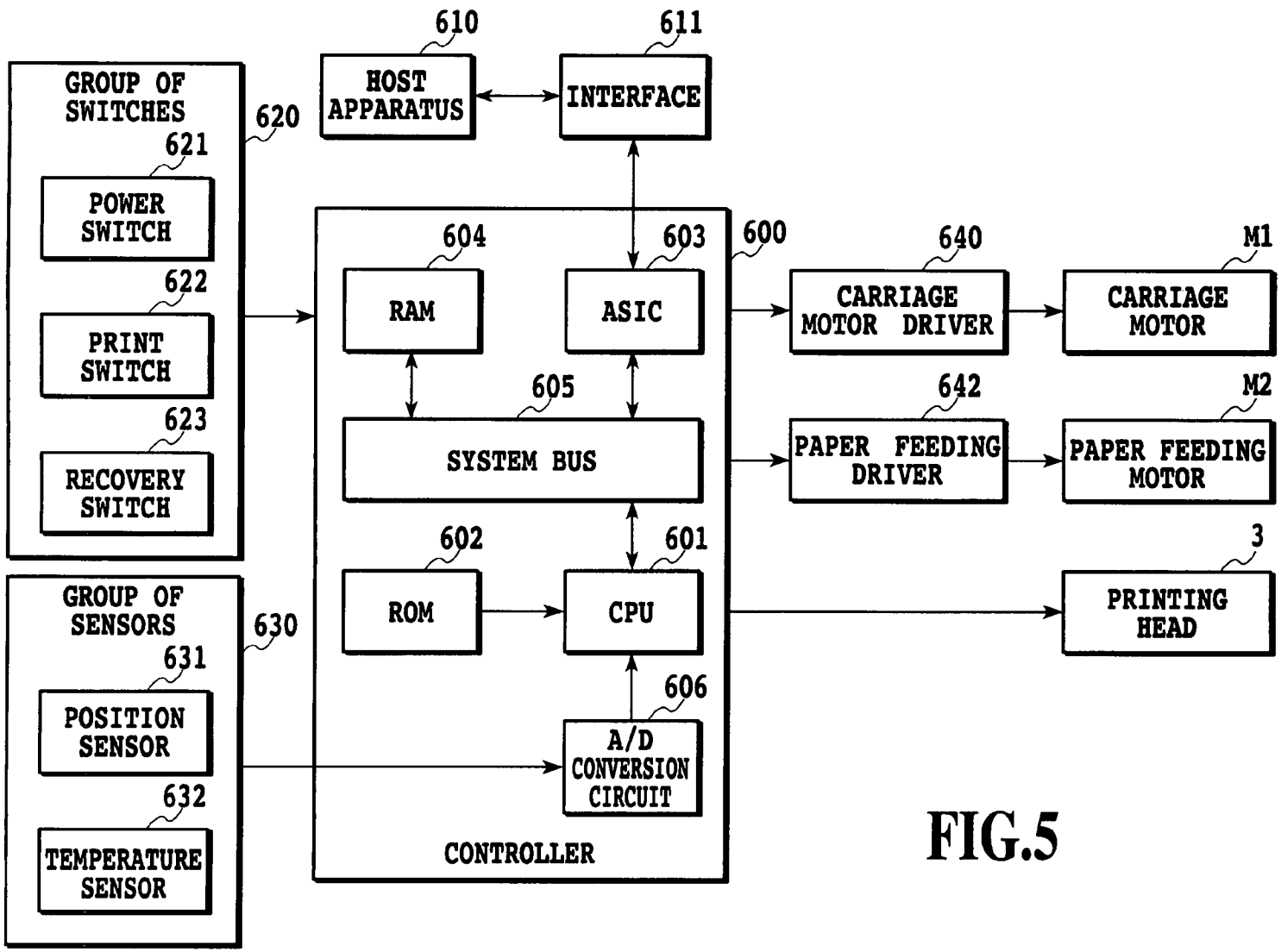
FIG. 5 is a block diagram schematically showing the configuration of a control system in the ink jet printer shown in FIG. 2.

FIG. 5 is a block diagram schematically showing the configuration of a control system in the ink jet printer configured as shown in FIG. 4.

As shown in FIG. 5, a controller 600 is composed of, for example, a CPU 601 in a microcomputer form, a ROM 602 that stores programs corresponding to the execution of various print modes described later, the control of printing operations in the respective print modes, and a sequence of image processing described later, required tables, and other fixed data, an application-specific integrated circuit (ASIC) 603 that generates control signals for the control of the carriage motor M1 and paper feeding motor M2 and the control of ejections from the printing head 3, during the execution of each print mode, a RAM provided with areas in which image data is expanded, work areas, and the like, a system bus 605 that connects the CPU 601, the ASIC 603, and the RAM 604 together to transmit data, and an A/D converter 606 which receives analog signals from a group of sensors described later to subject these signals to A/D conversions and which then supplies the digital signals to the CPU 601.

Reference numeral 610 denotes a host computer (or an image reader or a digital camera) operating as a source of image data. The host computer transmits and receives image data, commands, status signals, and the like to and from the controller 600 via an interface (I/F) 611.

Reference numeral 620 denotes a group of switches that accepts instruction inputs from an operator; the switches include a power switch 621, a switch 622 that instructs on the start of printing, and a recovery switch 623 that instructs on the activation of a recovery process for the printing head 3. Reference numeral 630 denotes the group of sensors, composed of, for example, a photo coupler 631 combined with the scale 8 to detect that the printing head 3 has been moved to its home position h and a temperature sensor 632 provided at an appropriate position in the printer to detect an environmental temperature. Moreover, reference numeral 640 denotes a driver that drives the carriage motor M1. Reference numeral 642 denotes a driver that drives the paper feeding motor M2.

With the above configuration, the printer according to the present embodiment analyzes a command for print data transferred via the interface 611 and expands image data to be printed into the RAM 602. The area (expansion buffer) into which the image data is expanded has a horizontal size of the number Hp of pixels corresponding to a printable area in the main scanning direction and a vertical size of 64n (n is an integer equal to or larger than 1), the number of pixels in the vertical direction which are printed during one scan using the nozzle rows in the printing head. The expansion buffer is provided on a storage area of the RAM 602. A storage area (print buffer) on the RAM 602 which is referenced in order to send data to the printing head during print scanning has a horizontal size of the number Vp of pixels corresponding to the printable area in the main scanning direction and a vertical size of 64n, the number of pixels in the vertical direction which are printed during one print scan of the printing head. The print buffer is provided on the storage area of the RAM 602.

When the printing head executes print scanning, the ASIC 603 acquires data on the driving of the heater for each ejection opening in the printing head while directly accessing the storage area (print buffer) of the RAM 620. The ASIC 603 transfers the data acquired to the printing head 3 (to the driver for the printing head 3).

Data Processing

In the present embodiment, multi-valued data for red (R), green (G), and blue (B) is subjected to predetermined image processing and thus converted into binary or three-valued data into which cyan, magenta, yellow, and black, the ink colors used in the present printer, are quantized. In the present embodiment, this process is executed by the host apparatus 610 but may be executed by a controller for the printer or the like.

The data processing according to the present embodiment is executed depending on a print mode described later. Specifically, print data is converted into binary or three-valued data depending on the print mode. In a print mode with a high printing speed, the print data is converted into binary data. In a print mode for a higher-quality image, the print data is converted into three-valued data. In the above data processing and printing operation, the unit or size of a pixel for processing corresponds to each ink dot that can be formed using two ejection openings (ejection openings in different ejection opening rows) in two ejection opening rows for the same ink color which openings are adjacent to each other in the sub-scanning direction with a spacing corresponding to half the ejection opening arrangement pitch of each ejection opening row. Such pixels cause dots to be formed at separate positions. More specifically, the unit of a pixel corresponds to an area having two dots formed at a lattice point.

Moreover, for bidirectional printing, the data processing distributes data in association with the two ejection opening rows for each color ink. Specifically, a print buffer is provided for each ejection opening row, and the binary or three-valued data is stored in the corresponding print buffer. Then, for each scan, data is read from the print buffer corresponding to each ejection opening row and transferred so as to eject the ink from the ejection opening in the ejection opening row.

(Binary Data)

If the data into which cyan, magenta, and yellow are quantized is binary, the same print buffer is used for the pair of two ejection opening rows (nozzle rows) for the same ink color.

Specifically, the same cyan first print buffer is assigned to the cyan nozzle row c1 and cyan nozzle row c2. Likewise, a magenta first print buffer is assigned to the magenta nozzle row m1 and magenta nozzle row m2. A yellow first print buffer is assigned to the yellow nozzle row y1 and yellow nozzle row y2. That is, in the case of, for example, cyan ink, all the binarized data is expanded into the cyan first print buffer. Then, during a forward scan, the binary data expanded into the cyan first print buffer is referenced and transferred in association with both cyan nozzle row c1 and cyan nozzle row c2 in the printing head. Thus, the ink is ejected from the corresponding ejection openings. Similarly, during a backward scan, the binary data expanded into the cyan first print buffer is referenced and transferred in association with both cyan nozzle row c1 and cyan nozzle row c2 in the printing head. Thus, the ink is ejected from the corresponding ejection openings. In this manner, in the present embodiment, the cyan nozzle row c1 and the cyan nozzle row c2 print the same image on a printing medium. That is, a pixel with binary data of 1 is composed of two dots formed using the ink ejected from the ejection openings in the different ejection opening rows for the same ink color. Similarly, for magenta or yellow, the magenta first print buffer or the yellow first print buffer, respectively, is referenced to print an image using two ejection opening rows.

In this case, the two dots constituting each pixel (with binary data of 1) are obtained from the different nozzle rows. Accordingly, as shown in FIG. 3, even for a secondary or tertiary color, two types of ink application orders are present. Therefore, for the entire print image, a number of dots are formed using one of the ink application orders, while the same number of dots are formed using the other ink application order. Thus, the difference in color ink application order or superimposition manner resulting from the difference in scanning direction is reduced both for each pixel and for the entire print image. It is thus possible to reduce the possibility that nonuniform colors occur.

As described later, the first black ink, a pigment ink, may be used depending on the print mode. The corresponding binary data is stored in one print buffer as in the case of normal printing. Further, for printing, the data is referenced and transferred in association with each ejection opening in the black ink chip 1200. This also applies to three-valued data.

(Three-Valued Data)

If the data into which cyan, magenta, and yellow are quantized has three values, dots are formed at three levels: no dots, 1 dot, and 2 dots. Correspondingly, the contents of the three-valued data are 0, 1, and 2; three-valued data of 0 corresponds to no data, three-valued data of 1 corresponds to 1 dot, and three-valued data of 2 corresponds to 2 dots.

In this case, the storage area is divided into a first print buffer and a second print buffer in association with the nozzle rows for each ink color for management. Specifically, the cyan first print buffer is assigned to the cyan nozzle row c1. The magenta first print buffer is assigned to the magenta nozzle row m1. The yellow first print buffer is assigned to the yellow nozzle row y1. The yellow second print buffer is assigned to the yellow nozzle row y2. The magenta second print buffer is assigned to the magenta nozzle row m2. The cyan second print buffer is assigned to the cyan nozzle row c2.

If the quantized three-valued data is 0, 0 indicating no data is expanded into both first and second print buffers. If the quantized three-valued data is 2, 1 indicating 1 dot data is expanded into both first and second print buffers. Thus, if the three-valued data for an ink color is 2, two dots from the different nozzle rows are formed for each pixel with three-valued data of 2 during either a forward or backward scan. If the quantized three-valued data is 1, 1 is expanded into one of the first and second print buffers, with 0 expanded into the other. In this case, every time the three-valued data has a value of 1 for the same ink color, data is stored indicating into which print buffer 1 has been expanded. Then, next time the three-valued data has a value of 1, the data expansion is controlled so as to switch the print buffer into which the data is expanded. Thus, during either a forward or backward scan, one dot is formed for a pixel with three-valued data of 1 using one of the different nozzle rows.

As a result of the distribution of three-valued data, each of the different nozzle rows is used to print the same number of dots when a large number of pixels are viewed in a macro manner. Accordingly, there are a number of dots formed with one of the two application orders as well as the same number of dots formed with the other application order. Consequently, the non-uniformity of the colors is relatively difficult to recognize.

As described above, the data processing executed if the quantized data is binary is suitable for the high-speed print mode because it involved a smaller amount of data to be processed than the data processing for three-valued data. Further, for the data processing for binary data, since two dots are formed for each pixel in the present embodiment, the resultant image has a lower grade in terms of a granular impression than one obtained through the processing for three-valued data, which uses 1 dot for a lower density portion of the print image. Accordingly, three-valued data is used in the high-quality print mode. In this connection, yellow, which is unlikely to be degraded in terms of the granular impression, may be subjected to binary quantization, while the other colors may be subjected to three-valued quantization.

Even if the gray level is expressed using four or more values, the same correspondences between the ejection opening rows and the print buffers as those for the distribution of three-valued data are used. As in the case of three-valued data, if an even number of dots are used for the expression, the data is expanded so that the same number of dots are printed in each of the first and second print buffers. If an odd number of dots are used for the expression, the data is expanded so that the number of dots printed in one of the first and second print buffers is one dot larger than that printed in the other print buffer. Then, every time the number of dots for the gray level expression for the same ink color is odd, data is stored indicating into which print buffer one-dot-larger data has been expanded. Next time the number of dots for a pixel is odd, the data is expanded so as to switch the print buffer into which one-dot-larger data is expanded.

For the black ink (second black ink), as shown in FIG. 2, the two ejection opening rows are not symmetrically arranged in contrast to the cyan, magenta, and yellow inks. The black print buffers and the distribution of quantized data are similar to those for cyan, magenta, and yellow, described above.

Specifically, if the quantized data is binary, the two nozzle rows share the same print buffer. If the quantized data has three values, the storage area is divided into the first and second print buffers in association with each nozzle row for management. That is, for management, the black first print buffer is assigned to the black nozzle row k1, whereas the black second print buffer is assigned to the black nozzle row k2. The three-valued data is distributed in the same manner as that used for the distribution of three-valued data for cyan, magenta, and yellow.

However, in contrast to cyan, magenta, and yellow, the ejection opening rows k1 and k2 for the second black ink are not symmetrically arranged as shown in FIG. 2. Accordingly, the order of application or superposing of the second black ink and the other color inks such as the cyan ink varies between the forward scanning and the backward scanning. Further, it is impossible that the number of dots formed with one of the two application orders is the same as that formed with the other application order.

Thus, as described later for the print mode, for an ink color for which such an application order varies between the forward scanning and the backward scanning and for which the number of dots formed with one of the two application orders cannot be made the same as that formed with the other application order, what is called multi-pass printing is executed for the bidirectional printing. Thus, even with dependence on image data, pixels can be randomly formed using dots with different application orders. The number of dots formed with an application order that occurs during the forward scanning can be made as similar as possible to that formed with an application order that occurs during the backward scanning.

One-Pass Printing

In the present embodiment, as described later in connection with the print mode, bidirectional printing is executed for one pass or multiple passes depending on the print mode. First, description will be given of one-pass printing according to the present embodiment.

Figure 6:
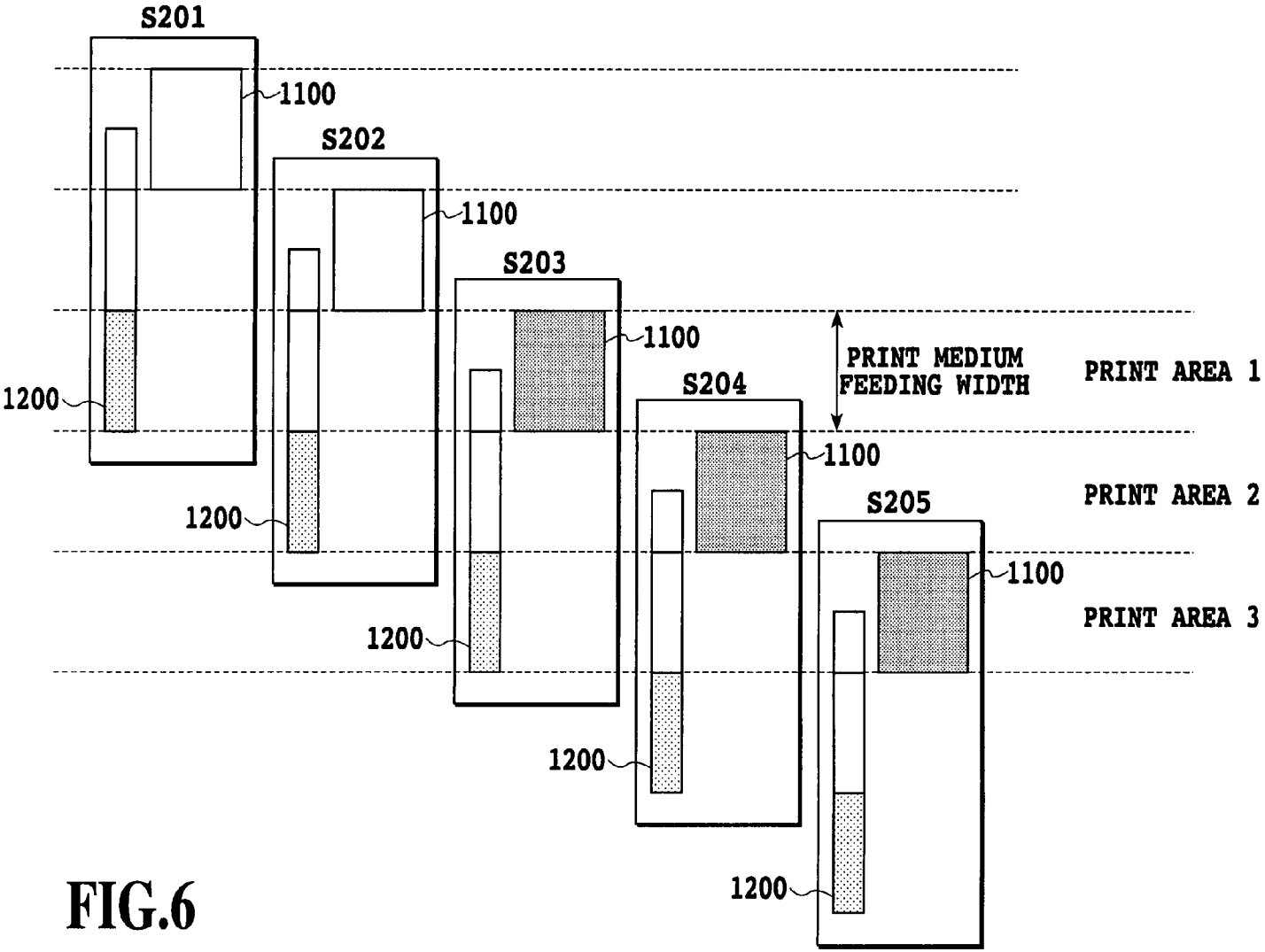
FIG. 6 is a diagram illustrating one pass printing.

FIG. 6 is a diagram schematically illustrating one-pass printing in which a color print is completed during one scan.

In the figure, reference numeral 1100 denotes the color ink chip shown in FIG. 1. Reference numeral 1200 denotes the black ink chip for the pigment black. FIG. 6 shows the width of each ejecting opening row as a width that can be printed by scanning. A shaded part in each chip indicates an ejection opening portion used for printing by scanning. Broken lines in the figure indicate the amount of printing medium conveyed during one sub-scan (paper feeding). Specifically, the amount of printing medium conveyed during one sub-scan is equal to 64n pixels, corresponding to the width of each color ejection opening row in the color ink chip shown in FIG. 2, for one scan of the printing head. Additionally, the lateral direction of the sheet of the drawing corresponds to the scanning direction of the printing head. The upper side of the sheet of the drawing corresponds to the downstream side of the conveying direction of the printing medium.

The one-pass printing according to the present embodiment has the mode in which both black ink chip and color ink chip are used and the mode in which only the color ink chip is used, as described later for the print mode. In the description below, both chips are used. However, clearly, a printing operation similar to the one shown below is also performed in the mode in which only the color ink chip is used. Accordingly, its description is omitted. Further, in the one-pass mode, the ejection rows k1 and k2 for the second black ink in the color ink chip 1100 are not used.

First, in a forward scan S201, a print area 1 is printed using the pigment black ink chip 1200.

Then, the printing medium is conveyed by a distance corresponding to 64n pixels. Then, in a backward scan S202, a print area 2 is printed using the pigment black ink chip 1200.

Then, the printing medium is conveyed by the distance corresponding to 64n pixels. Then, in a forward scan S203, a print area 3 is printed using the pigment black ink chip 1200. At the same time, the print area 1 is printed using the color ink chip 1100.

In the subsequent forward and backward scans S204, S205, . . . between which conveyance by the distance corresponding to 64n pixels is interposed, two print areas are printed using the respective chips as in the case of the scan S203. Thus, an image is completed.

According to the present printing operation, the same print area can be printed one printing scan earlier with the pigment black ink than with the color inks. This allows the color inks to be applied after the pigment black ink has sufficiently permeated through the printing medium. It is thus possible to suppress the possible bleeding between black and the other colors. Furthermore, the non-uniformity of the colors attributed to the application order of the color inks can be reduced because there are a number of dots formed with one of the two application orders as well as the same number of dots formed with the other application order, as described above.

Multi-Pass Printing

In the present embodiment, a random mask is used to generate data for each of a plurality of scans that complete a predetermined print area in multi-pass printing. Then, printing is controlled on the basis of the data generated. The print control will be described below on the basis of the random mask and the data generated using the random mask. The multi-pass printing is in the mode in which the pigment black ink that is the first black ink and the dye black ink that is the second black ink are used in addition to the cyan, magenta, and yellow inks, as described later for the print mode.

(Creation of Random Mask)

Figure 7:
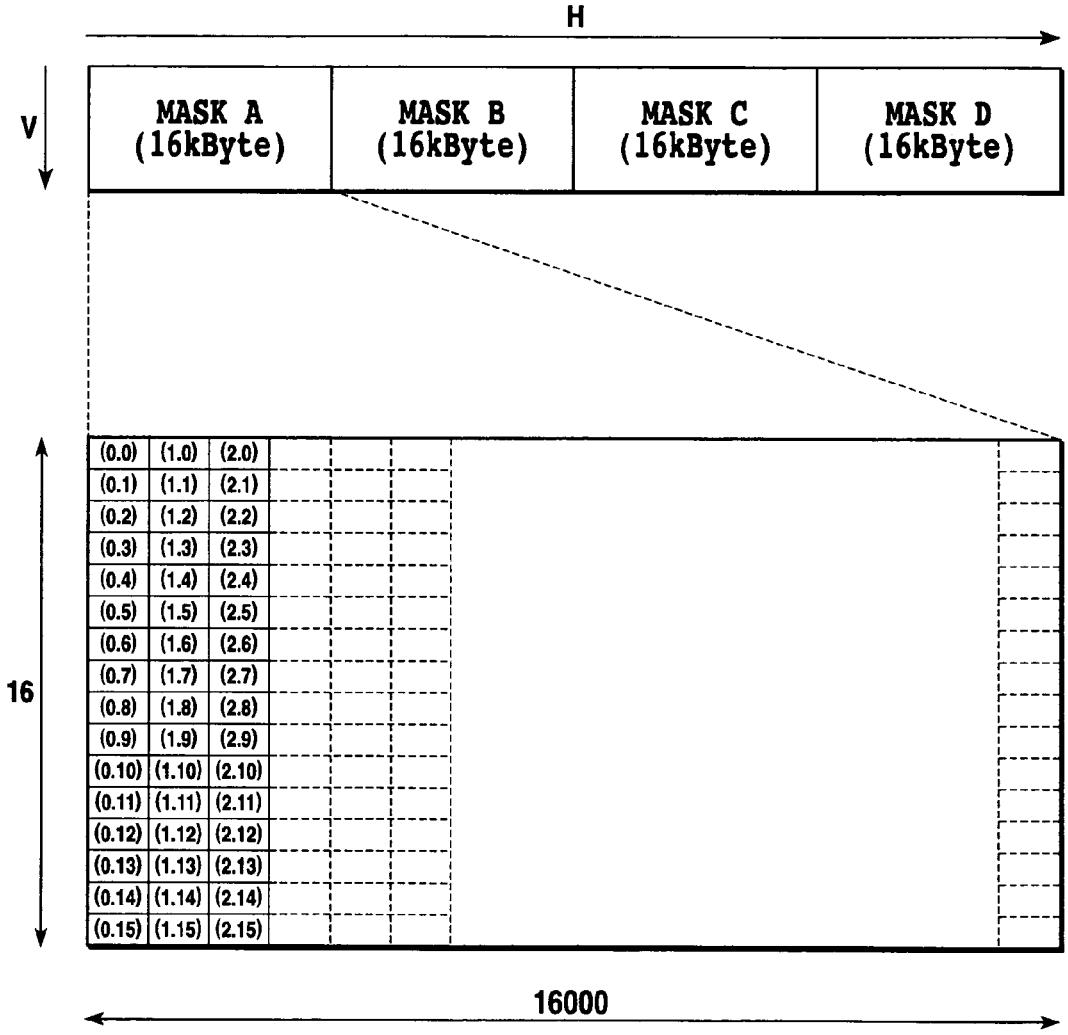
FIG. 7 is a diagram illustrating a mask used for multipass printing.

FIG. 7 is a diagram schematically showing the configuration of a mask that completes an image in the same print area through four scans.

The mask is composed of four areas named a mask A, a mask B, a mask C, and a mask D. Each of the masks A, B, C, and D is composed of 16 kilobytes (1 kilobyte is 16,000 bits). Specifically, as shown in FIG. 7, each mask is composed of 16 bits×16,000 bits. The relationship between the bits in the vertical direction and the bits in the horizontal direction agrees with the relationship between the pixels in the vertical direction and the pixels in the horizontal direction, all the pixels constituting quantized image data. The position of a pixel in the mask is managed by defining the vertical direction as V and the horizontal direction as H as shown by the arrows in the figure. Each of the masks A, B, C, and D can be managed in the horizontal direction H by successively expanding the masks A, B, C, and B on a storage element. According to this manner of management, the leading position of the mask A is (H, V)=(0, 0). The leading position of the mask B is (H, V)=(16,000, 0). The leading position of the mask C is (H, V)=(16,000×2, 0). The leading position of the mask D is (H, V)=(16,000×3, 0).

Figure 8:
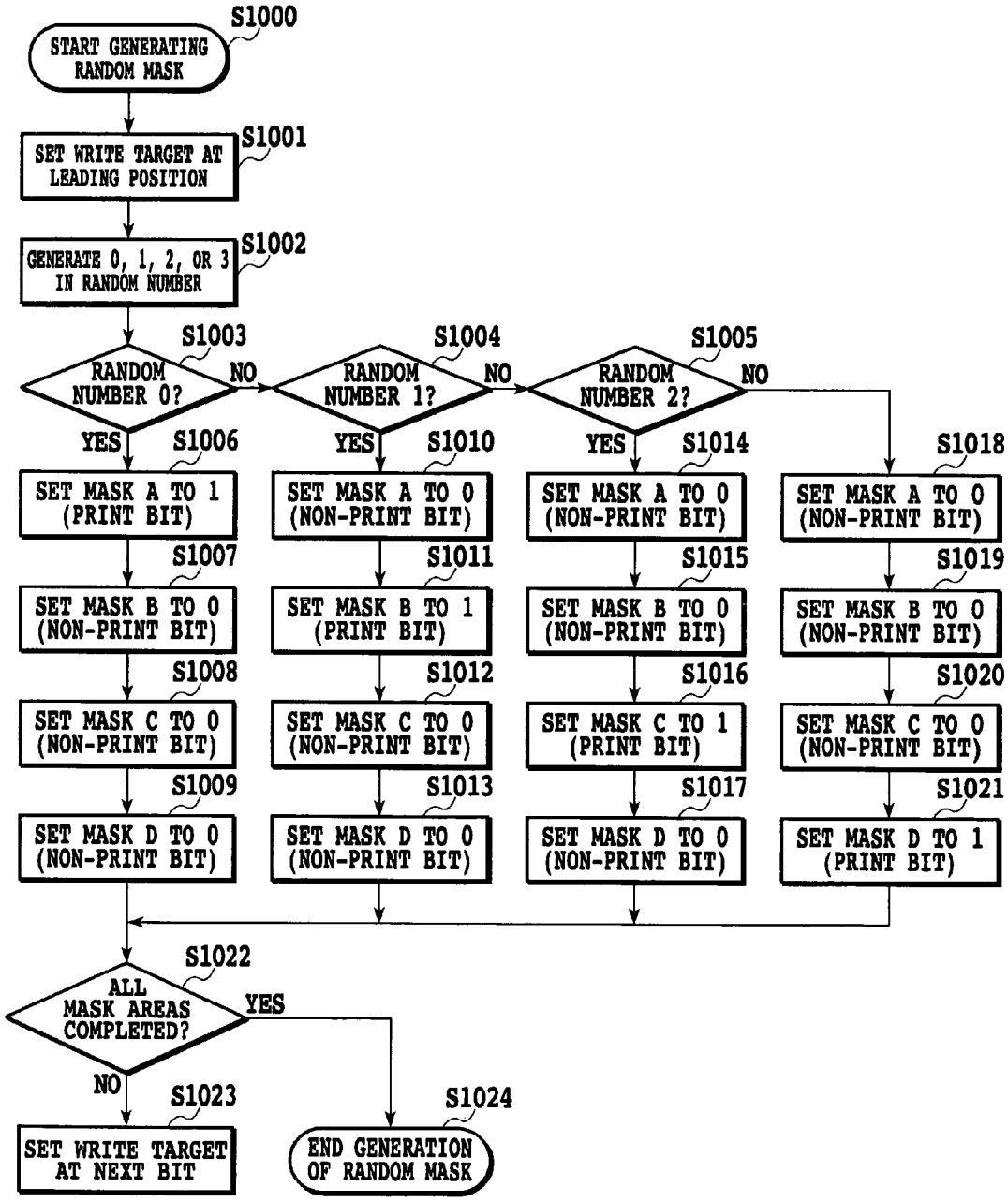
FIG. 8 is a flow chart showing a procedure to generate a random mask.

FIG. 8 is a flow chart showing a procedure to generate a random mask according to the present embodiment.

In step S1000, a random mask starts to be created. Then, in step S1001, a position to start mask setting is set at the leading position of the mask. That is, the mask A is set at (H, V)=(0, 0). The mask B is set at (H, V)=(16,000, 0). The mask C is set at (H, V)=(16,000×2, 0). The mask D is set at (H, V)=(16,000×3, 0). Then, in step S1002, a random number composed of 0, 1, 2, or 3 is generated. Then, in steps S1003, S1004, and S1005, printing or non-printing is set for each mask on the basis of the value of the random number.

If the random number is 0, this is determined in step S1003 and the processing in steps S1006, S1007, S1008, and S1009 is executed. Specifically, in step S1006, 1 is set for the mask A as a print bit. Here, the print bit enables the data on a pixel in the image data which corresponds to a pixel in the mask. If for example, the binary data on that pixel is 1, this means that a dot is formed in that pixel. In contrast, a non-print bit means that the data on a corresponding pixel is disabled. Then, in steps S1007, S1008, and S1009, 0 is set for the masks B, C, and D as a non-print bit. Likewise, if the random number is 1, the print bit is set for the mask B, while the non-print bit is set for the other masks. If the random number is 2, the print bit is set for the mask C, while the non-print bit is set for the other masks. If the random number is 3, the print bit is set for the mask D, while the non-print bit is set for the other masks. After the mask setting has been processed for each pixel, it is determined in step S1022 whether or not the entire area has been set. That is, it is determined whether or not the current setting position is (H, V)=(16,000, 16). If it is determined in step S1022 that not the entire area has been set, the process proceeds to step S1023. In step S1023, a position on the mask is specified which is to be set next time. At this time, 1 is added to the current V coordinate. However, if the current V coordinate is 16, V is set at 1 and 1 is added to the H coordinate for each of the masks A, B, and C, and D. After the process in step S1023, the process proceeds to step S1002 to repeat the above process. If it is determined in step S1022 that the entire area of the mask has been set, the process proceeds to step S1024 to finish the process of generating a random mask.

(Print Control)

The random mask can be set for a printable area on a printing medium. The coordinates of the printable area on the printing medium are defined as Hp in the main scanning direction and Vp in the sub-scanning direction. In the present embodiment, multi-pass printing is executed to complete the image in the same print area via four scans.

The present printer analyzes a command for print data transferred via the I/F 611 (FIG. 5) and expands image data to be printed into the RAM 602. The area (expansion buffer) on the RAM into which the image data is expanded has a horizontal size of Vp pixels corresponding to the printable area and a vertical size of 16n pixels that is one fourth of 64n. Further, the storage area (print buffer) on the RAM 602 which is referenced for scanning has a horizontal size of Vp pixels corresponding to the printable area and a vertical size of 64n pixels, the width in the vertical direction which is printed during a scan of the printing head.

The ASIC of the present printer has a function to specify the start portion of a random mask as the H coordinate in the horizontal direction of the print buffer for every 16 pixels in the vertical direction of the print buffer. The ASIC also has a function to return to the leading position of the random mask upon reaching the terminal of the random mask in the horizontal direction of the print area. That is, for the horizontal direction of the print area, the ASIC repeats H=0 to 16,000 in the horizontal direction of the random mask.

On the basis of the above configuration, during a scan of the printing head, the ASIC associates the image data in the print buffer with the data for the random mask, while directly referencing the storage area to subject both data to AND. The ASIC then transfers driving data to the printing head.

In the present embodiment, an image is completed via four scans, so that an image corresponding to one fourth of the vertical width of the printing head is completed during one scan of the printing head. Accordingly, on the downstream side in the printing medium conveying direction, one fourth of the image data expanded into the print buffer during one scan of the printing head is unwanted. Thus, the unwanted area of the print buffer is used as the expansion buffer to expand the image data, while the storage area that has been used as the expansion buffer is used as one fourth of the print buffer. That is, the storage area is managed for every one fourth of the width printed by a scan of the printing head. Then, the five managed areas are used as the expansion buffer and print buffer in a rotational manner.

Figure 9:
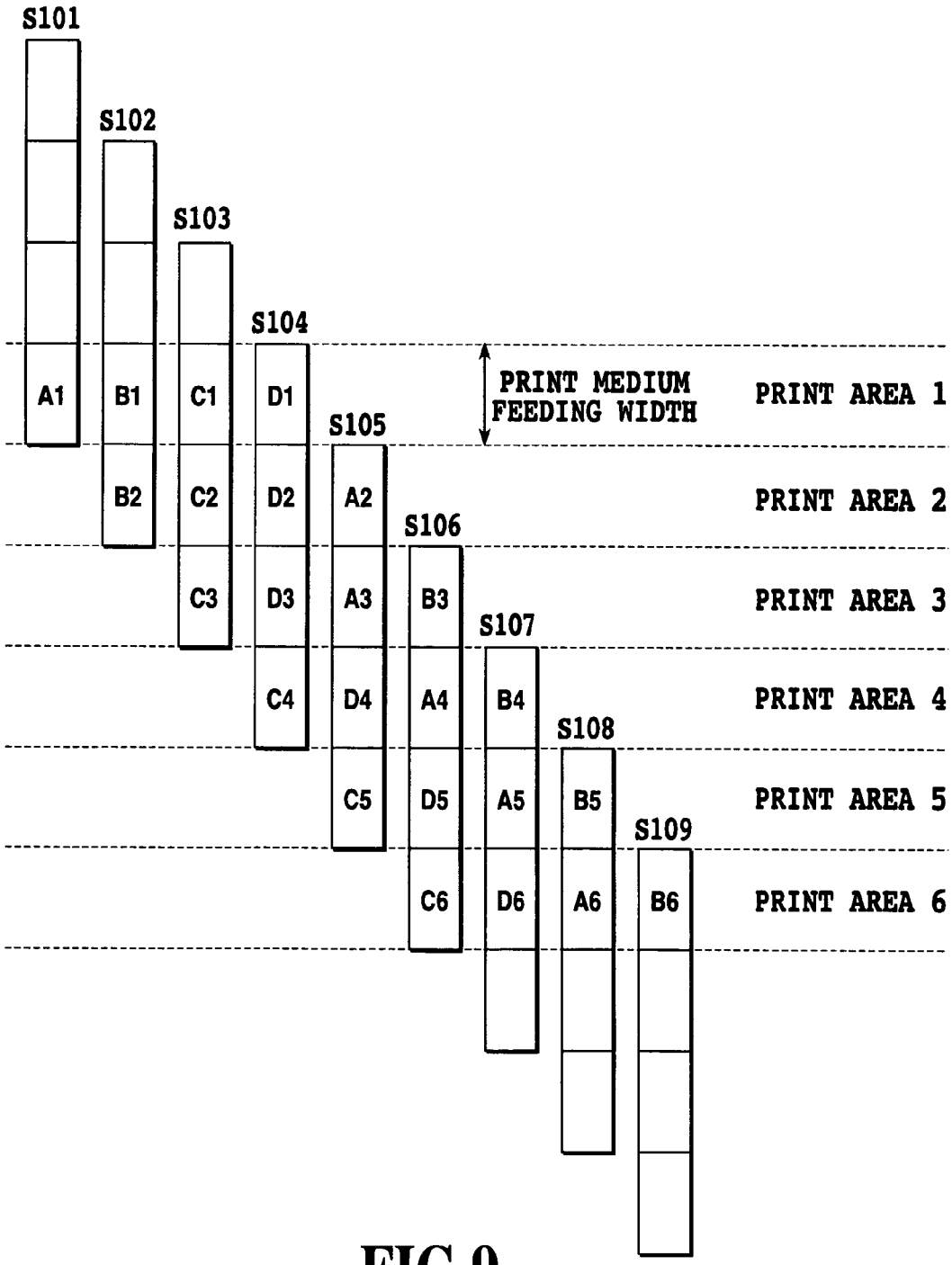
FIG. 9 is a diagram illustrating the multi-pass printing and a mask pattern used it.

FIG. 9 is a diagram illustrating a mask used for a printing operation and each scan for the printing operation according to the present embodiment.

In the figure, broken lines indicate the amount of printing medium conveyed during one sub-scan. According to the present embodiment, the amount of printing medium conveyed during one sub-scan is 16n pixels, one fourth of the vertical width printed during one scan of the printing head. Additionally, the lateral direction of the sheet of the drawing corresponds to the scanning direction of the printing head. The upper side of the sheet of the drawing corresponds to the downstream side of the conveying direction of the printing medium.

In FIG. 9, reference numerals such as A1, B1, C1, and D1 are the management numbers of start points of the random masks A, B, C, and D. Since the masks have the different start points, the different masks are used for the respective print areas and respective scans. For the same print area, the four masks are complementary to one another. Here, the same number indicates that the start position of the random mask is offset by 16,000 pixels in the horizontal direction.

Print Mode

In the present embodiment, in a configuration that executes bidirectional printing using many types of inks, different print modes are executed depending on the types of inks used, in order to suppress increase of size of the printing head at minimum and to suppress the non-uniformity of the colors or color drifts attributed to the bidirectional printing.

In the present embodiment, as shown in Table 1 below, if only the ejection opening rows for the cyan, magenta, and yellow inks in the color ink chip 1100 (FIG. 2) of the printing head are used, and if not only the ejection opening rows for these inks but also the black ink chip 1200 for the pigment black ink are used, then one-pass bidirectional printing is executed on the basis of binary data. This is because for each pixel and for the entire image, the number of dots formed with one of the two ink application orders or superimposition manners can be set to be the same as that formed with the other ink application order or superimposition manner. Further, in the print mode of the present embodiment in which the pigment black ink is used, the pigment black ink is applied prior to the application of color ink such as cyan ink or the like regardless of the direction of printing scan. This avoids the application order problem.

Figure 10:
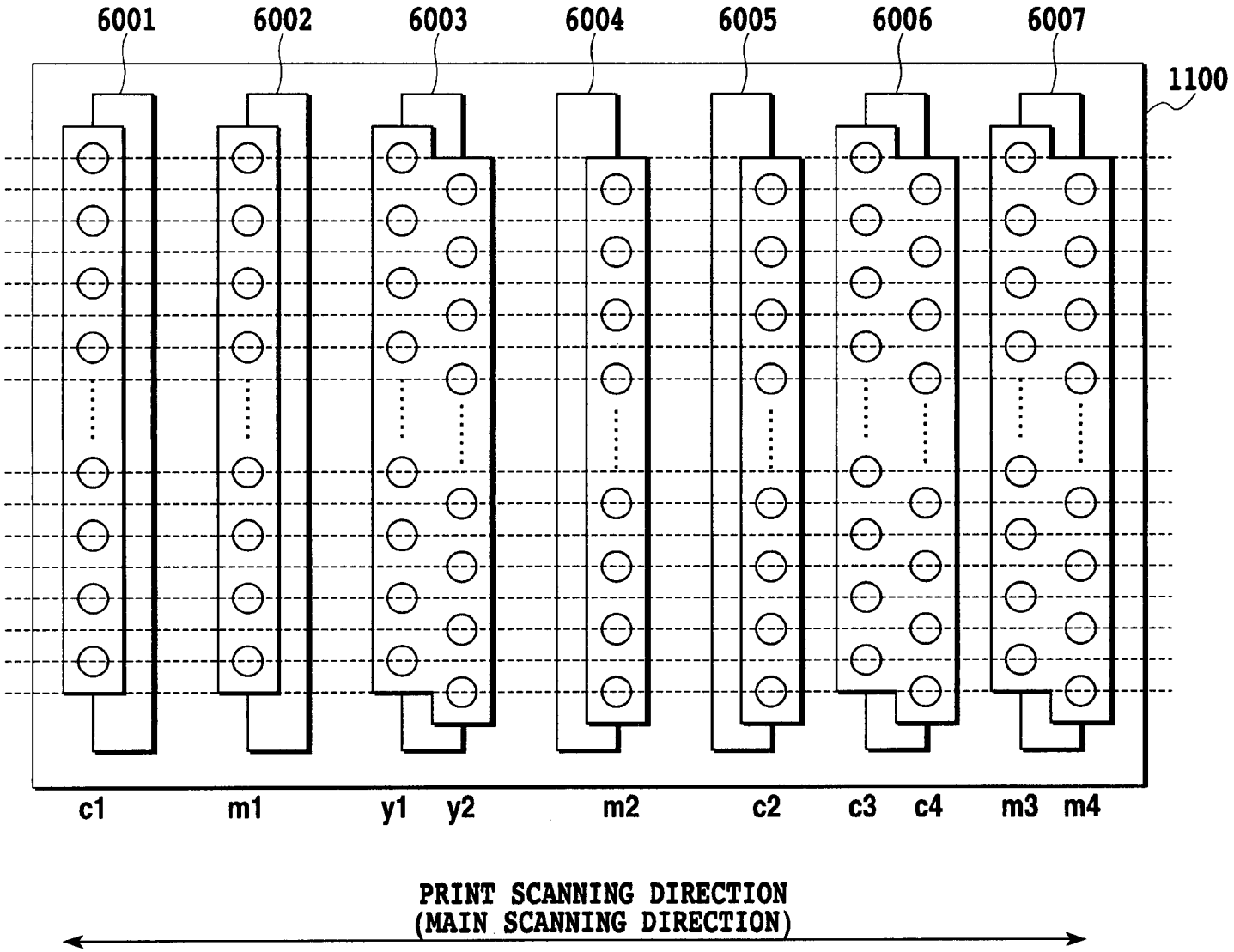
FIG. 10 is a diagram showing the arrangement of ejection opening rows in a variation of the color ink chip of the printing head used in another embodiment of the present invention.

On the other hand, if the ejection opening for the dye black ink in the color ink chip 1100 is used in addition to the ejection openings for the color inks such as the cyan ink, multi-pass printing is executed on the basis of three-valued data. Specifically, in the present embodiment, to more favorably express, for example, the gray level, the dye black is superposed on the other color inks at a relatively high gray level. In this case, as shown in FIG. 2, since the ejection opening rows k1 and k2 for the dye black ink are not symmetrically arranged, the difference in the application order of the dye black ink and other color inks cannot be eliminated for each pixel. Accordingly, even with dependence on image date, the multi-pass printing is executed to make the number of dots formed with one of the two application orders as similar as possible to that formed with the other application order, for each raster or for the entire image. That is, as previously described, if in addition to the symmetrically arranged ejection opening rows for the cyan, magenta, and yellow inks, another color or type of ink is used, when all these ejection opening rows are symmetrically arranged in association with the bidirectional printing, the size of the printing head increases. Accordingly, the ejection opening rows for such an ink are asymmetrically arranged between two rows constituting a group of symmetrically arranged ejection opening rows or outside the group as shown in FIG. 2. Then, in the print mode using these ejection opening rows, multiple passes are used to execute bidirectional printing. The term "symmetrical arrangement" of the ejection openings or ejection opening rows need not necessarily mean that the ejection openings or ejection opening rows are geometrically symmetric with respect an axis orthogonal to the scanning direction. As shown in FIGS. 2 and 10, between the symmetrical ejection opening rows, the ejection openings may positionally deviate from each other in the axial direction. Alternatively, asymmetrically arranged ejection openings or ejection opening rows may be arranged between two arbitrary rows constituting a group of symmetrically arranged ejection opening rows.

As described above, the dye black ink is used when the multi-pass printing is executed taking the application order into account. However, for example, the gray level can of course be expressed by superposing the pigment black ink on the other inks. In such a mode, the multi-pass printing may be executed as described above.

Table 1 below shows a specific example of the use of the print modes according to the present embodiment described above.

In Table 1, a mode 1 is a print mode in which the cyan, magenta, yellow, and pigment black inks are used to print ordinary paper at high speed without using the dye black. In the mode 1, one-pass bidirectional printing is executed.

In a mode 2, the same inks as those in the mode 1 are used to print ordinary paper so as to achieve a high grade. In this case, it is possible to execute the one-pass bidirectional printing taking the possible non-uniformity of the colors into account. However, since the multi-pass printing generally provides a high-quality image, the multi-pass bidirectional printing is executed. Further, in addition to the pigment black ink, the dye black ink may be used to, for example, smooth the expression of the gray level. The dye black is suitable for the gray level expression because dye print dots have a lower optical density than pigment print dots.

In a mode 3, the cyan, magenta, and yellow inks are used to print coat paper at high speed. Thus, the one-pass bidirectional printing is executed.

In a mode 4, the dye black, cyan, magenta, and yellow inks are used to print coat paper so as to obtain a high-quality image. Thus, the multi-pass bidirectional printing is executed.

In a mode 5, the dye black, cyan, magenta, and yellow inks are used to print gloss paper so as to obtain a high-quality image. Thus, the multi-pass bidirectional printing is executed.

TABLE 1

| Print mode name | Printing medium | Inks used | Print control |
|---|---|---|---|
| Mode 1 | Ordinary paper | Pigment black, cyan, magenta, yellow | One pass |
| Mode 2 | Ordinary paper | Pigment black (dye black), cyan, magenta, yellow | Multi-pass |
| Mode 3 | Coat paper | Cyan, magenta, yellow | One pass |
| Mode 4 | Coat paper | Dye black, cyan, magenta, yellow | Multi-pass |
| Mode 5 | Gloss paper | Dye black, cyan, magenta, yellow | Multi-pass |

The print mode may be selected by the operator via the group of switches 620 or the host apparatus 610. Alternatively, for example, the present printer or the host apparatus may determine the type of a printing medium and the type of an image to be printed (for example, a document, a graph, or a photograph) and select the print mode in accordance with the determinations.

Second Embodiment

In the first embodiment, one ink color is added to the cyan, magenta, and yellow inks. However, in the present embodiment, two ink colors are added to the cyan, magenta, and yellow inks.

FIG. 10 is a diagram showing the configuration of the ejection opening rows in the color ink chip 1100 according to the present embodiment.

In the present embodiment, a low-concentration cyan ink (also referred to as light cyan ink herein) and a low-concentration magenta ink (also referred to as light magenta ink herein) are additionally used. This makes it possible to eliminate the granular impression from the expression of an image in a low-lightness part. In FIG. 10, ejection opening rows c3 and c4 are for the light cyan ink. Ejection opening rows m3 and m4 are for the light magenta ink.

The color ink chip 1100 is provided with seven grooves. Specifically, a first groove 6001, a second groove 6002, a third groove 6003, a fourth groove 6004, a fifth groove 6005, a sixth groove 6006, and a seventh groove 6007 are formed in this order in the scanning direction. In the present embodiment, the cyan ink is supplied to the first groove 6001 and fifth groove 6005. The magenta ink is supplied to the second groove 6002 and fourth groove 6004. The yellow ink is supplied to the third groove 6003. The light cyan ink is supplied to the sixth groove 6006. The light magenta ink is supplied to the seventh groove 6007.

The cyan nozzle row c1, composed of 64n (n is an integer equal to or larger than 1) ejection openings (each with the ink passage in communication with it and the heater), is formed in the first groove 6001. Likewise, the magenta nozzle row m1, composed of 64n ejection openings, is formed in the second groove 6002. The yellow nozzle row y1, composed of 64n ejection openings, is formed on the second groove side of the third groove 6003. The yellow nozzle row y2, composed of 64n ejection openings, is formed on the fourth groove side of the third groove 6003. The magenta nozzle row m2, composed of 64n ejection openings, is formed in the fourth groove 6004. The cyan nozzle row c2, composed of 64n ejection openings, is formed in the fifth groove 6005. The light cyan nozzle row c3 is formed on the fifth groove side of the sixth groove 6006. The light cyan nozzle row c4, composed of 64n ejection openings, is formed on the seventh groove side of the sixth groove 6006. The light magenta nozzle row m3, composed of 64n ejection openings, is formed on the sixth groove side of the seventh groove 6007. The light magenta nozzle row m4, composed of 64n ejection openings, is formed adjacent to the nozzle row m3 of the seventh groove 6007.

As is apparent from the above arrangement of the nozzle rows, a first combination of inks that can form two types of dots with different application orders includes the cyan, magenta, and yellow inks. On the other hand, a second combination of inks that can form dots with an application order varying depending on the scanning direction of the printing head includes the cyan, magenta, yellow, light cyan, and light magenta inks.

Print modes using the first and second combinations of inks, respectively, are similar to those described in the first embodiment. In the mode using the second combination of inks, multi-pass bidirectional printing is executed. The procedure to process data is similar to the one described in the first embodiment.

According to the present embodiment, as in the case of the first embodiment, in a configuration for bidirectional printing, it is possible to achieve high-speed and high-grade printing particularly with the reduced non-uniformity of the colors, while minimizing an increase in the size of the print head. Further, it is possible to realize a high-image-quality mode by eliminating the granular impression from a low-brightness part of an image.

Table 2 below shows a specific example of the use of the print modes of the present embodiment.

In a mode 1, the cyan, magenta, yellow, and pigment black inks are used to print ordinary paper at high speed. In the mode 1, the one-pass bidirectional printing is executed.

In a mode 2, the cyan, magenta, yellow, and pigment black inks as well as the light cyan and magenta inks are used to print ordinary paper so as to achieve a high grade. Thus, in the mode 1, the multi-pass bidirectional printing is executed.

In a mode 3, the cyan, magenta, and yellow inks are used to print coat paper at high speed. Thus, the one-pass bidirectional printing is executed.

In a mode 4, the cyan, magenta, yellow, light cyan, and light magenta inks are used to print coat paper so as to obtain a high-quality image. Thus, the multi-pass bidirectional printing is executed.

In a mode 5, the cyan, magenta, yellow, light cyan, and light magenta inks are used to print gloss paper so as to obtain a high-quality image. Thus, the multi-pass bidirectional printing is executed.

TABLE 2

| Print mode name | Printing medium | Inks used | Print control |
|---|---|---|---|
| Mode 1 | Ordinary paper | Pigment black, cyan, magenta, yellow | One pass |

TABLE 2-continued

| Print mode name | Printing medium | Inks used | Print control |
|---|---|---|---|
| Mode 2 | Ordinary paper | Pigment black, cyan, magenta, yellow, light cyan, light magenta | Multi-pass |
| Mode 3 | Coat paper | Cyan, magenta, yellow | One pass |
| Mode 4 | Coat paper | Cyan, magenta, yellow, light cyan, light magenta | Multi-pass |
| Mode 5 | Gloss paper | Cyan, magenta, yellow, light cyan, light magenta | Multi-pass |

Other Embodiments

In the above first embodiment, the dye black ink is added to the cyan, magenta, and yellow inks to enable the gray level to be appropriately expressed. In the second embodiment, the light cyan and magenta inks are used to enlarge a color reproduction area for a low-lightness part. However, of course, the inks added to the cyan, magenta, and yellow inks are not limited to these black inks or the inks of low color material densities.

For example, instead of the black ink or the like, a special color ink such as an orange, green, or blue ink may be used to enlarge a color reproduction area for orange, green, or blue. Further, inks may be added to the cyan, magenta, and yellow inks in order to improve the gray level. For example, to improve the expression of a low-lightness yellow part, a low-lightness yellow or gray ink may be used in place of the black ink.

In this case, the print modes using these inks is configured so that multi-pass and bidirectional printing is performed and thus reduce the non-uniformity of color due to the difference in applying orders of these inks, without symmetrical arrangement for the ejection opening rows of these inks.

As described above, in a configuration for bidirectional printing, it is possible to achieve high-speed and high-grade printing particularly with the reduced non-uniformity of the colors, while minimizing an increase in the size of the printing head even if special inks are used to enlarge the color reproduction area or improve the gray level.

As described above, according to the embodiments of the present invention, in bidirectional printing in which the printing head is scanned in a forward and backward directions for printing, when any of the second combination of inks is used for which the ink overlapping order varies between the forward scanning and the backward scanning, the second print mode for what is called multi-pass printing is executed which completes printing a print area by carrying out a plurality of scans and associating different ejection openings with the respective scans. Accordingly, even if an ink is added to the first combination of inks for which there are two ink overlapping orders that differ between the forward scanning and the backward scanning, the multi-pass printing can be used to reduce the possible non-uniformity of the colors attributed to the bidirectional printing without, for example, symmetrically arranging the ejection openings for the added ink as in the case of the first combination of inks.

As a result, in an ink jet printing apparatus configured to execute bidirectional printing using many types of inks, it is achieved to perform high speed and high-grade printing by reducing the non-uniformity of the colors attributed to the bidirectional printing, while preventing an increase in the size of a printing head.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus that causes a printing head to eject ink to a printing medium to perform printing, said apparatus comprising:

scanning means for performing a forward scan and a backward scan of the printing head along a main scanning direction;

conveying means for conveying the printing medium in a direction intersecting with the main scanning direction;

the print head on which a plurality of nozzle arrays, each of which has a plurality of nozzles arranged, are arranged in the main scanning direction, said print head having a plurality of nozzle arrays for cyan, magenta, and yellow inks which nozzle arrays are symmetrical with respect to an axis perpendicular to the main scanning direction, and said print head having a nozzle array for pigment black ink and nozzle arrays for dye black ink which are arranged to be in an asymmetrical position with respect to other color nozzle arrays, wherein the nozzle arrays for dye black ink are arranged so that the nozzle arrays for dye black ink and the nozzle arrays for cyan, magenta and yellow inks are capable of being used for printing a same area in one scan of the print head, wherein a width of the nozzle array for pigment black ink in a nozzle arrangement direction is longer than that of the nozzle arrays for cyan, magenta, yellow and dye black inks, and wherein the nozzle array for pigment black ink is located at a different position in the nozzle arrangement direction than the nozzle arrays for cyan, magenta, yellow and dye black inks; and control means for performing printing on the printing medium by causing a printing operation in which printing is performed during the scan of the print head by said scanning means and a conveying operation in which conveying of the printing medium by said conveying means to be repeated alternately to perform printing on the printing medium, wherein said control means is capable of performing printing of a first print mode, which completes printing on a predetermined area of the printing medium with one scan of the printing head, and performing printing of a second print mode, which completes printing on a same predetermined area of the printing medium with a plurality of scans of the printing head and causes the conveying operation with a smaller conveying amount of the printing medium in one conveying operation by said conveying means than that in the first print mode, and wherein said control means performs printing using only the nozzle arrays for cyan, magenta, yellow and pigment black inks in the first mode and performs printing using the nozzle arrays for cyan, magenta, yellow, and dye black inks in the second print mode.

2. The ink jet printing apparatus as claimed in claim 1, wherein said control means generates data used in one scan of the printing head in the main scanning direction according to a mask pattern in the second print mode.

3. The ink jet printing apparatus as claimed in claim 1, wherein said control means causes the printing operation of the first print mode so as to be capable of forming two dots which differ in overlapping order to one pixel constituting the predetermined area and the printing operation of the second print mode so as to be capable of forming dots which are dots after overlapping order is varied or dots before overlapping order is varied corresponding to a pixel in one pixel line constituting the predetermined area.

* * * * *